United States Patent [19]

Harris et al.

[11] 4,312,397

[45] Jan. 26, 1982

[54] PROCESS FOR FORMING SHELL MOLDS

[75] Inventors: David L. Harris, Oregon City; Colin Taylor, Lake Oswego, both of Oreg.

[73] Assignee: Dependable-Fordath, Inc., Sherwood, Oreg.

[21] Appl. No.: 140,296

[22] Filed: Apr. 14, 1980

[51] Int. Cl.[3] ..... B22C 9/12

[52] U.S. Cl. ..... 164/7.1; 164/16; 164/21

[58] Field of Search ..... 164/12, 16, 21, 165, 164/166

[56] References Cited

U.S. PATENT DOCUMENTS

| | | | |
|---|---|---|---|
| 2,991,521 | 7/1961 | Bryant et al. | 164/21 |
| 4,079,773 | 3/1978 | Dunlop | 164/16 |
| 4,089,363 | 5/1978 | Dunlop | 164/16 |
| 4,232,726 | 11/1980 | Michelson | 164/165 X |

OTHER PUBLICATIONS

"Simpli-Mold", Dependable Shell Core Machine Inc., Portland, OR, Bulletin No. 124, Mar. 1973.

*Primary Examiner*—Robert D. Baldwin
*Assistant Examiner*—K. Y. Lin
*Attorney, Agent, or Firm*—Klarquist, Sparkman, Campbell, Leigh, Whinston & Dellett

[57] ABSTRACT

A pattern holder 12 and a sand tank 14 are rotatably mounted on a frame 16 so that the pattern holder can be inverted over and sealably mounted atop the sand tank. A vented pattern 26 is secured to the pattern holder and forms a first chamber between one side of the pattern and the interior of the pattern holder. A second chamber 90 is formed between the other side of the pattern and the interior of the sand tank when the pattern holder adjoins the sand tank. O-ring seals 32 and 80 isolate the chambers from the atmosphere so that a partial vacuum can be formed therein. A mixture 84 of sand and a gas-curable binder is provided in the sand tank so that the mixture will fall onto the pattern upon inverting the sand tank over the pattern holder. A flexible line 42 is provided for controllably introducing a gas catalyst into the chamber 38 in order to cure a portion of the sand-binder mixture to form a shell mold 94 of a predetermined thickness on a pattern face 36 of the pattern. Flexible lines 41 and 43 are provided for evacuating and purging the chamber 38 at different stages in the process.

2 Claims, 8 Drawing Figures

10
12
14
16
18
20
22
24
26
28
30
32
34
36
38
40
41
42
43
60
64
66
70
72
74
76
78
80
82
84
90

10
12
14
16
18
20
22
24
26
28
30
32
34
36
38
40
41
42
43
60
64
70
72
74
76
78
80
82
84
90

10
12
14
16
18
20
22
24
26
28
30
32
34
36
38
40
41
42
43
60
64
66
70
74
76
80
82
84
90
92

10
12
14
16
18
20
22
24
26
28
30
32
34
36
38
40
41
42
43
60
64
70
72
74
76
80
82
84
90
94

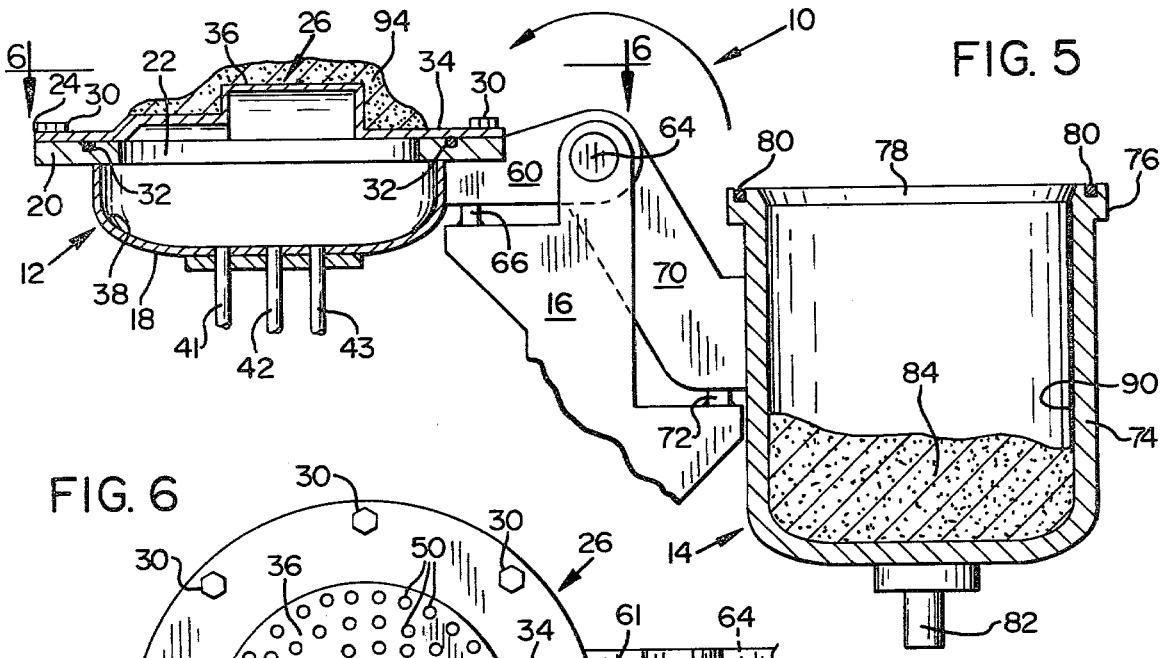
FIG. 5
FIG. 6
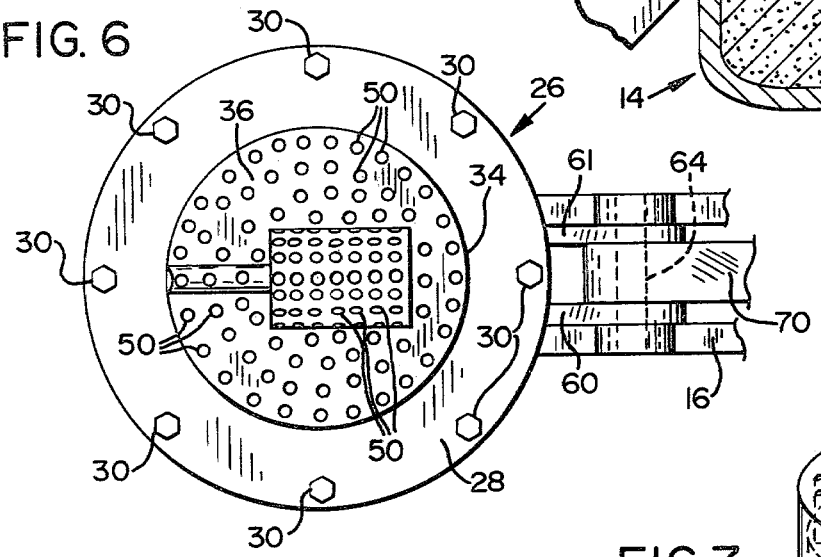
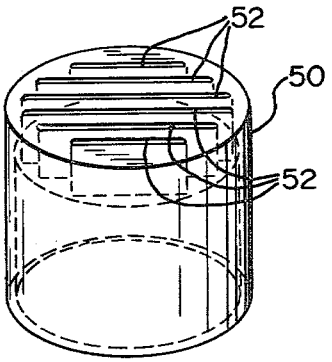
FIG. 7
FIG. 8
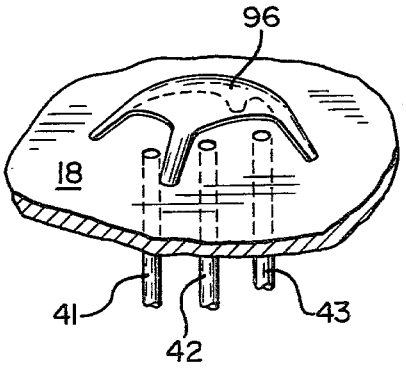

PROCESS FOR FORMING SHELL MOLDS

The present invention pertains to the so-called "cold box" technique for forming shell molds which are used to make metal castings, the shell molds being formed from a mixture of sand and a gas-curable binder.

It is a principal object of the present invention to provide an improvement over the basic "cold box" process described in U.S. Pat. No. 4,089,363, the terms of which are incorporated by reference herein insofar as they are not inconsistent with the description which follows.

Another object is to provide an apparatus for the efficient and effective production of shell molds using a "cold box" process.

Another object is to provide a process for forming shell molds from resin-coated sand in a manner in which the portion of the resin-coated sand not used in one shell-forming cycle is reclaimed for use in subsequent process cycles.

Other objects of the invention will become apparent on consideration of an illustrative embodiment thereof described in conjunction with the accompanying drawings, in which:

FIGS. 1–5 are vertical cross-sections schematically depicting a preferred apparatus at different stages in a process for forming shell molds in accordance with the present invention;

FIG. 6 is a plan view of a typical vented pattern secured to a portion of the apparatus;

FIG. 7 is a perspective view of a typical vented insert element, a plurality of which are contained in the vented pattern; and FIG. 8 is a perspective view of a deflector plate employed in a modified form of the preferred apparatus.

Figure 1:
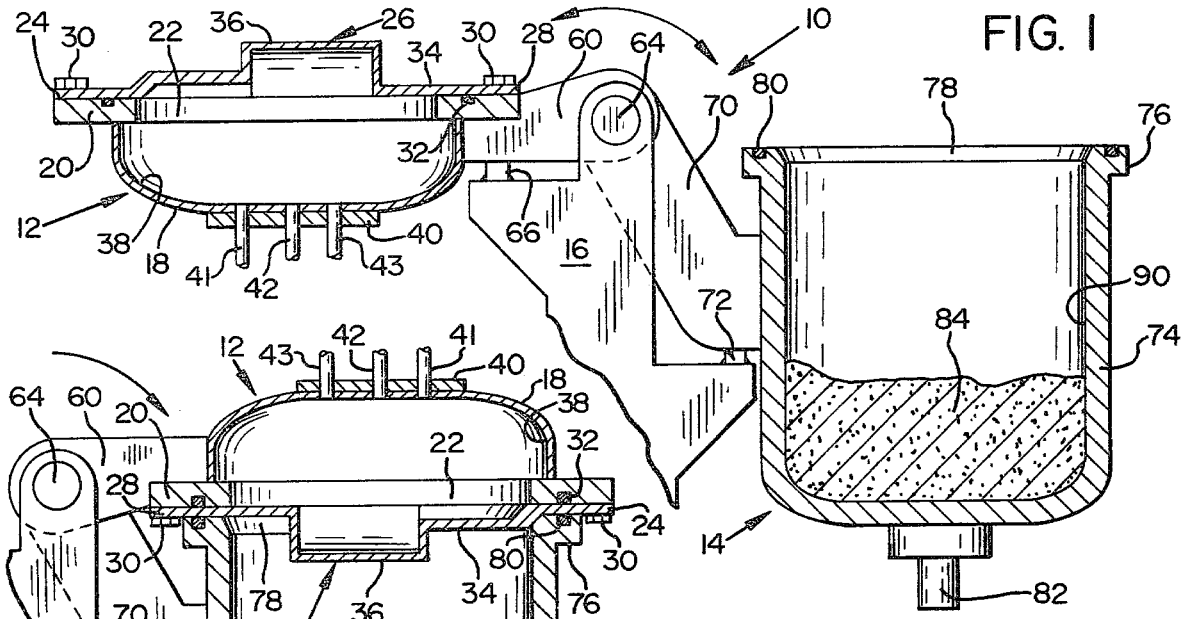

With reference to FIG. 1, an apparatus for forming shell molds in accordance with the invention is illustrated and designated generally by reference numeral 10. The apparatus 10 is shown in an open position at an initial stage during the inventive process. The apparatus 10 includes a pattern holder 12 and a sand tank 14 which are pivotally supported at a common axis by a frame 16, shown only partially for convenience of illustration. The pattern holder 12 comprises a case 18 rimmed by an annular flange 20 which defines an opening 22. The flange 20 has a flat upper surface 24 to which a vented pattern 26 having a peripheral flange 28 is secured in a suitable manner, such as by means of threaded fasteners 30. Carried in a recess in the annular flange 20 is a conventional O-ring 32 adapted to sealingly engage the peripheral flange 28 inwardly from the threaded fasteners 30. The pattern 26 has an interior portion 34 supported over the opening 22 by the peripheral flange 28. It will be appreciated that the interior portion 34 can assume various desired shapes for producing different shell molds in accordance with the process to be described below. The upper surface of the interior portion 34 defines a shell-forming surface or pattern face indicated by reference numeral 36. A gas dispersion chamber 38 is defined by the interior surfaces of the case 18 and pattern 26. A manifold 40 is secured to the bottom of the case 18 as a means for introducing flexible tubes or gas lines 41, 42 and 43 into the chamber 38.

Referring to FIG. 6, it will be seen that the pattern 26 includes a plurality of vented insert elements 50 disposed in a uniform arrangement throughout the interior portion 34. The preferred insert element 50, which is illustrated separately in FIG. 7, has a cylindrical body and a plurality of slotted vents 52 passing therethrough. Such vented insert elements 50 are conventional in the art. Supporting the pattern holder 12 are two pivot arms 60 and 61 which are spaced apart as seen in FIG. 6 and are journaled on a pivot pin 64 carried in the frame 16.

When the pattern holder 12 is in its upright position as depicted in FIG. 1, the pivot arms 60 and 61 abut a rest 66 which is supported by or forms a part of frame 16. Similarly, the sand tank 14 is supported by a pivot arm 70 journaled on the pin 64 between the arms 60 and 61, the arm 70 abutting a rest 72 on the frame 16 when the tank 14 is in its upright position as depicted in FIG. 1.

Figure 2:
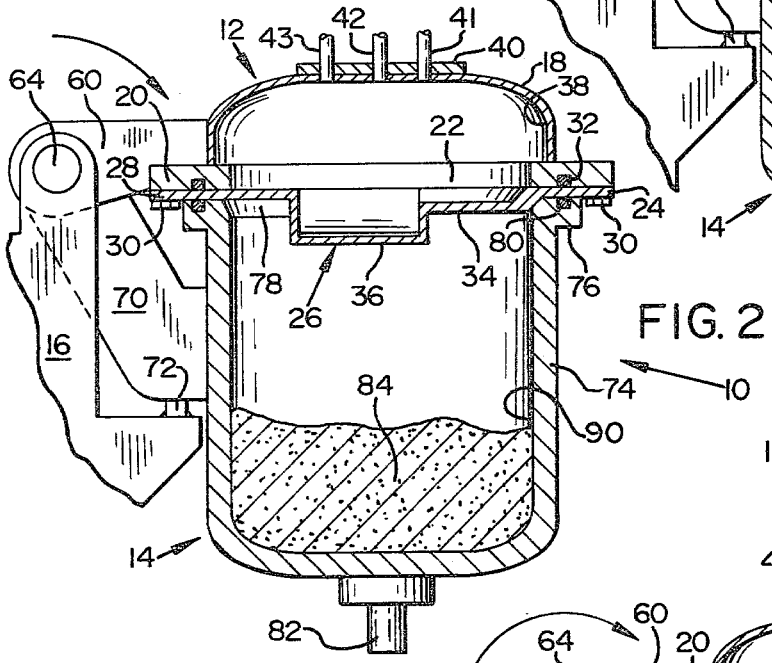

The tank 14 comprises a bucket-like case 74 having an annular rim 76 defining a large diameter opening 78 at its upper end. Carried in a recess in the rim 76 is a conventional O-ring 80 adapted to sealingly engage the peripheral flange 28 when the pattern holder 12 and sand tank 14 are brought together as shown in FIG. 2. Secured to the bottom of the sand tank 14 is a conventional vibrator 82, the purpose of which will become apparent from the description which follows.

In accordance with the preferred process, a suitable gas-curable binder, such as a phenolic or an isocyanate resin in a solvent, is mixed with foundry sand in accordance with known "cold box" techniques. The tank 14 is then partially filled with the sand-binder mixture as indicated by reference numeral 84 in FIG. 1. The pattern holder 12 is then rotated about the pivot pin 64 to an inverted position as depicted in FIG. 2 wherein the peripheral flange 28 is seated on the annular rim 76 and against the O-ring 80, thereby forming an air-tight seal therewith and defining a second chamber 90 between the pattern 26 and the interior of the tank 14. At this stage in the process, the seals formed by the O-rings 32 and 80 isolate the dispersion chamber 38 and the second chamber 90 from the atmosphere and from each other except for gaseous communication between chambers via the vents 52 in the pattern 26. In an alternate arrangement contemplated by the invention, a modified pattern 26 could be mounted entirely within the annular flange 20 and sealed against the surfaces that define the opening 22. In such an arrangement, the annular flange 20 could be seated directly on the annular rim 76, thus eliminating the need for one of the two O-rings 32 and 80 along with the respective recess in the flange 20 or rim 76. It will be appreciated that the invention is adaptable to other sealing arrangements suitable for isolating the chambers 38 and 90 from the atmosphere.

Next, the partial vacuum is pulled in the chambers 38 and 90 by pumping gas out through the line 41. In accordance with an important advantage of the invention over the prior art systems, gas flows freely from the second chamber 90 into the dispersion chamber 38 through the vents 52 without interference from the sand-binder mixture 84. The system described in U.S. Pat. No. 4,089,363 necessitates pulling a vacuum while the sand-binder mixture is in contact with the vented pattern, thus requiring more pumping effort and tending to clog the vents in the pattern.

Figure 3:
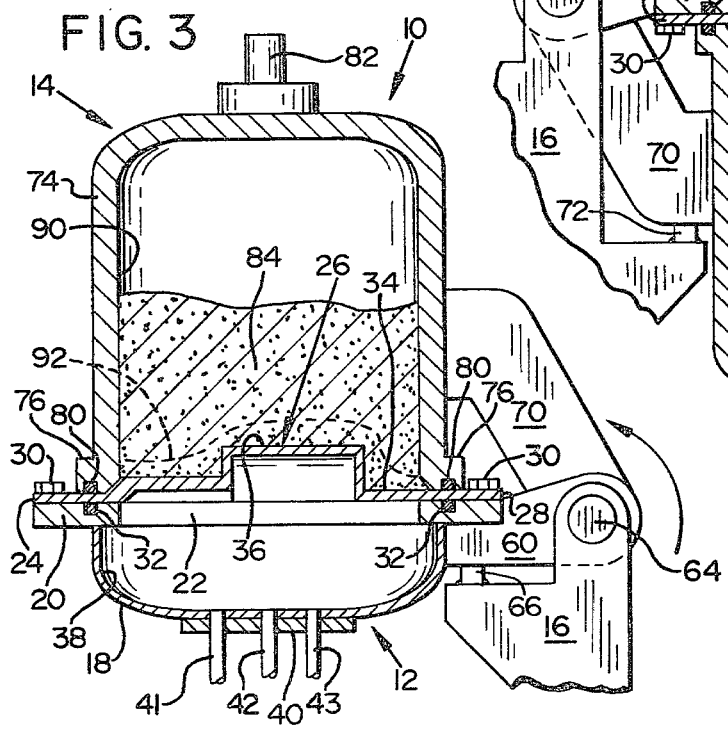

Once the desired negative pressure within the chambers 38 and 90 has been reached, the preferred pressure being about −15 in. hg., the sand tank 14 and adjoining pattern holder 12 are rotated about the pivot pin 64 to invert the sand tank 14 over the pattern holder 12 as depicted in FIG. 3 so that the sand-binder mixture 84 will fall onto the pattern face 36. The vibrator 82 is then activated in order to pack and distribute the mixture 84 evenly against the pattern face 36. Performing the vibration step after evacuating the chambers 38 and 90 is believed to produce improved shell integrity.

Figure 4:
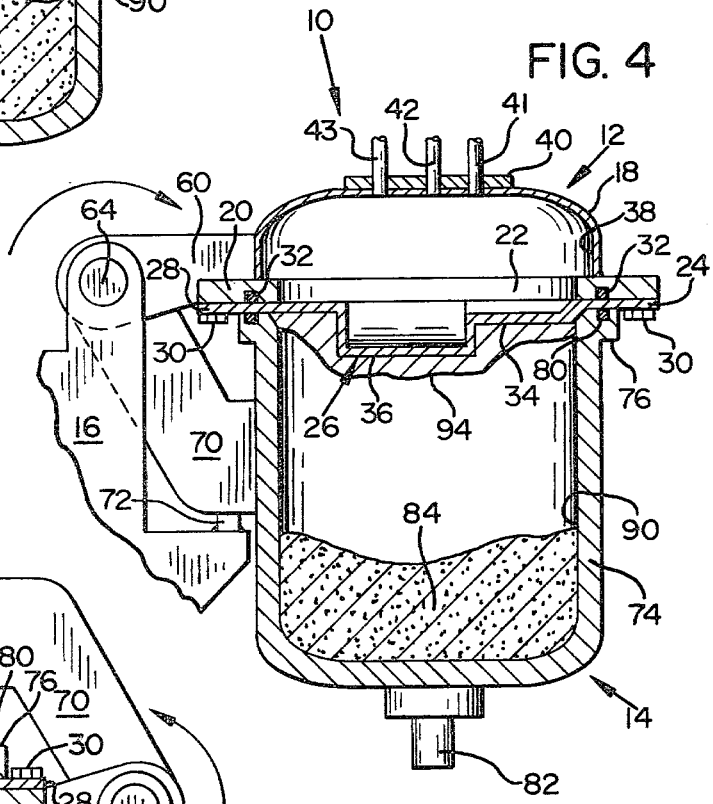

Next, a gas catalyst is introduced through line 42 until the negative pressure has been reduced to a predetermined level, preferably about −5 in. hg. A suitable gas catalyst for use with a binder of phenolic resin or isocyanate resin is dimethylethylamine introduced via a suitable carrier gas such as carbon dioxide. A portion of the sand-binder mixture adjacent to the pattern 36 is hardened by exposure to the gas catalyst. The level of gas penetration, and thus hardening, which is depicted by the dashed line 92, is determined by controlling the pressure change brought on by the entering gas catalyst. Once the sand-binder mixture has hardened to the desired level, line 42 is closed and the gas catalyst is withdrawn from the chamber 38 through line 41. In so doing, the chamber 38 is pumped back down slightly beyond the initial negative pressure, which in this example was −15 in. hg. Next, the sand tank 14 and the pattern holder 12, still sealably joined together, are rotated to the position shown in FIG. 4. This allows the non-hardened mixture 84 to fall to the bottom of the sand tank 14 leaving a shell mold 94 of resin-bonded sand adhering to the pattern face 36. Then, the chamber 38 is preferably purged with dry air introduced through line 43. The chamber 38 is then returned to atmospheric pressure and the pattern holder 12 is separated from the sand tank 14 and rotated back to its upright position as shown in FIG. 5. The shell mold 94 is then separated from the pattern face 36 in a suitable manner, such as by means of conventional stripping pins (not shown). The apparatus 10 is then ready to begin the next process cycle.

Referring now to FIG. 8, a modification of the apparatus 10 will be described. Depending on the velocity of the gas catalyst entering the chamber 38 through line 42, it may be desirable to provide a deflector 96 for diverting the flow of gas catalyst from its entry direction to several lateral directions for improved dispersion. Use of the deflector 96 is advantageous at relatively high flow rates which might otherwise produce a shell mold having an uneven thickness. It will be appreciated, therefore, that the deflector 96 permits even curing at such relatively high flow rates, thereby reducing production time.

Other advantages of the invention will be apparent to those skilled in the art. For example, the rotatable feature of the pattern holder 12 and sand tank 14 greatly improves production efficiency. Contrary to certain prior art techniques, it is not necessary to heat the pattern 26, thus conserving energy. It will be readily apparent that chemicals and other materials are also conserved by the inventive process. While the apparatus has been described with particular reference to making a shell mold, it will be obvious that the apparatus and process described are equally applicable to the making of shell cores. Thus, the term shell molds, when used herein, should be deemed to encompass both shell molds and shell cores.

Although preferred embodiments of the inventive apparatus and process have been described in detail, it is to be understood that various changes, substitutions, and alterations can be made therein without departing from the spirit and scope of the invention as defined in the appended claims.

What is claimed is:

1. A process for forming shell molds and shell cores using a sand tank, a pattern holder, a vented pattern mounted on the pattern holder and forming a first chamber therewith, and means for controllably introducing gas into and withdrawing gas from the first chamber, the process comprising the sequential steps of:

1. providing a mixture of granular material and a gas-curing binder in the sand tank;
b. sealably mounting the pattern holder atop the sand tank to form a second chamber defined between the vented pattern and the interior of the sand tank, the chambers communicating through vents in the vented pattern;
c. pulling a partial vacuum in the chambers by withdrawing gas from the first chamber;
d. then inverting the joined sand tank and pattern holder to allow the mixture to fall onto shell-forming surfaces of the vented pattern;
e. introducing a gas catalyst into the first chamber to cure a predetermined amount of the mixture adjacent to the vented pattern to form a shell of a predetermined thickness;
f. withdrawing the gas catalyst from the chambers by pulling a vacuum pressure greater than the partial vacuum initially pulled, thereby to prevent further curing;
g. then inverting the joined sand tank and pattern holder to allow the uncured mixture to fall away from the shell, the chambers still remaining under vacuum;
h. returning the chambers to atmospheric pressure;
i. separating the pattern holder from the sand tank; and
j. removing the shell from the shell-forming surfaces.

2. The process of claim 1 further comprising the step of purging the chambers with dry air between steps g and h.

* * * * *